US008366944B2

(12) United States Patent
Choi et al.

(10) Patent No.: US 8,366,944 B2
(45) **Date of Patent: *Feb. 5, 2013**

(54) IMAGE DRUM AND FABRICATING METHOD THEREOF

(75) Inventors: Jin-seung Choi, Suwon-si (KR); Eung-yeoul Yoon, Suwon-si (KR); Kyu-ho Shin, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1262 days.

This patent is subject to a terminal disclaimer.

(21) Appl. No.: 12/143,926

(22) Filed: Jun. 23, 2008

(65) Prior Publication Data

US 2009/0092927 A1 Apr. 9, 2009

(30) Foreign Application Priority Data

Oct. 5, 2007 (KR) ..... 10-2007-0100203

(51) Int. Cl.
*H01B 13/00* (2006.01)
*B44C 1/22* (2006.01)

(52) U.S. Cl. ..... 216/13; 216/41; 216/58; 216/83; 29/854; 29/887

(58) Field of Classification Search ..... 216/13, 216/41, 58, 83; 29/854, 887, 825
See application file for complete search history.

(56) References Cited

U.S. PATENT DOCUMENTS

| | | | | |
|---|---|---|---|---|
| 5,483,269 | A * | 1/1996 | van Stiphout et al. | 347/55 |
| 7,784,177 | B2 * | 8/2010 | Back et al. | 29/846 |
| 8,051,561 | B2 * | 11/2011 | Yoon et al. | 29/854 |
| 2004/0089813 | A1 * | 5/2004 | Takabayashi et al. | 250/370.11 |
| 2006/0118403 | A1 * | 6/2006 | Taguchi et al. | 204/168 |
| 2007/0138018 | A1 * | 6/2007 | Choi et al. | 205/127 |

* cited by examiner

*Primary Examiner* — Shamim Ahmed
(74) *Attorney, Agent, or Firm* — Stanzione & Kim, LLP

(57) ABSTRACT

A method of fabricating an image drum includes preparing a hollow drum body having a slot extending in a longitudinal direction, preparing a printed circuit board (PCB) having a plurality of board terminals, mounting the PCB inside the hollow drum body with a fixing member such that the board terminals of the PCB are placed in the slot of the hollow drum body, coating a first insulating layer on an outer circumference of the hollow drum body, forming a plurality of ring electrodes on the first insulating layer corresponding to the board terminals of the PCB, in which a portion of ring electrodes which corresponds to the board terminals of the PCB is non-continuous, exposing the board terminals below non-continuous area of the ring electrodes by etching the first insulating layer with the ring electrodes as an etching mask, and forming a connecting electrode to electrically connect the board terminals to the ring electrodes.

14 Claims, 12 Drawing Sheets

IMAGE DRUM AND FABRICATING METHOD THEREOF

CROSS-REFERENCE TO RELATED APPLICATIONS

This application claims priority under 35 U.S.C. §119(a) from of Korean Patent Application No. 10-2007-0100203, filed on Oct. 5, 2007, in the Korean Intellectual Property Office, the disclosure of which is hereby incorporated herein in its entirety by reference.

BACKGROUND OF THE INVENTION

1. Field of the Invention

The present general inventive concept relates to an image drum to selectively adsorb toner to form an image, and more particularly, to an image drum which provides a simpler fabrication process, a reduced unit price and an increased productivity, and a fabricating method thereof.

2. Description of the Related Art

FIG. 1 is a side view of an image forming apparatus employing a conventional image drum therein, FIG. 2 is a perspective view of a conventional image drum, and FIG. 3 is a cross-section view of a part of the image drum of FIG. 2.

Referring to FIG. 1, an image forming apparatus includes a toner feed part 40, an image drum 10 to adsorb toner 1 off of the toner feed part 40 by using an electrostatic force, a magnetic cutter 50 to disengage some of the toner 1 from the image drum 10, and a toner recovery part 60 to recover the toner 1, which has been disengaged from the image drum 10, back into the toner feed part 40.

Specifically, part of the toner 1, which is fed from the toner feed part 40 to the image drum 10, is disengaged from the image drum 10 by the magnetic cutter 50, and the remaining toner 1 on the image drum 10 is transferred via an image transfer part 70 and fixed onto a printing paper. As a result, an image is printed onto the printing paper.

Referring to FIGS. 2 and 3, an image drum 10 generally includes a cylindrical drum body 12. The cylindrical drum body 12 is made out of a metal such as aluminum or an aluminum alloy. A plurality of ring electrodes 14 are formed circumferentially on an outer surface of the cylindrical drum body 12. Each of the ring electrodes 14 is covered with a thin insulating layer in order to be kept electrically nonconductive from the cylindrical drum body 12 and other electrodes. The ring electrodes 14 are provided in various arrangements according to a desired resolution. For example, the ring electrodes 14 are formed on the cylindrical drum body 12 rather densely, that is, at pitches of approximately 40 μm in order to realize a resolution of 600 dpi.

A printed circuit board (PCB) 16 including a control chip is mounted in the cylindrical drum body 12, in which a terminal 18 is formed on a side to contact the cylindrical drum body 12. The PCB 16 may apply a high voltage to the ring electrodes 14 through the terminal 18. Referring to FIG. 3, a conductive material 32 is charged in holes 24 and 26 of the ring electrodes 14. The conductive material 32 is electrically connected to a zebra-strip 36. A silicon dioxide film 34 is formed on the inner wall of the holes 24 and 26 in order to insulate the cylindrical drum body 12 and the ring electrodes 14 from each other.

In order to fabricate a conventional image drum 10, a plurality of holes with a width of 20 μm are first formed at the intervals of approximately 40 μm in a surface of the cylindrical drum body 12 by using a diamond cutting device. A laser beam or an electric beam may be used to form the holes with a width of 20 μm along a circumference of the cylindrical drum body 12.

Next, holes are pierced through the cylindrical drum body 12 using a laser beam, each having a larger-diameter hole 26 formed from within the cylindrical drum body 12 and a smaller-diameter hole 24 formed from an internal surface or an external surface of the cylindrical drum body 12. Next, an insulating layer such as a silicon dioxide film 34 is formed over the cylindrical drum body 12 and the holes 24 and 26 in order to form the ring electrodes 14, and the piercing holes 24 and 26 are filled with a conductive material 32. The outer surface of the cylindrical drum body 12 is removed to a predetermined depth by polishing in order to form the ring electrodes 14 and electric connecting parts within the piercing holes 24 and 26. An insulating layer is then formed on the surface of the cylindrical drum body 12, and the PCB 16 is mounted.

As explained above, it takes a considerably complicated process to form the ring electrodes 14 on the surface of the cylindrical drum body 12, which includes forming densely spaced holes with a precision cutting device, forming piercing holes in the cylindrical drum body 12, forming a silicon dioxide film 34, and charging the piercing holes with a conductive material 32. In particular, the process of drilling holes and charging the holes with the conductive material 32 in order to connect the ring electrodes 14 with the terminal 18 of the PCB 16 takes a considerable amount of time and is also costly.

SUMMARY OF THE INVENTION

The present general inventive concept provides a method for fabricating an image drum which is easy to fabricate and which provides an improved quality of printing.

Additional aspects and utilities of the present general inventive concept will be set forth in part in the description which follows and, in part, will be obvious from the description, or may be learned by practice of the general inventive concept.

The present general inventive concept also provides a method of fabricating an image drum which is fabricated quickly, beneficial for mass-producing, and available with economic unit price due to a reduced fabricating cost.

The present general inventive concept also provides a method of fabricating an image drum, which provides the image drum with an economic price, by omitting a precision laser processing to form a connecting part between ring electrodes and a terminal of a printed circuit board (PCB).

The present general inventive concept also provides an image drum which is fabricated by the above fabrication methods.

The foregoing and/or other aspects and utilities of the present general inventive concept may be achieved by providing a method of fabricating an image drum. The method of fabricating an image drum may include preparing a hollow drum body having a slot extending in a longitudinal direction, preparing a printed circuit board (PCB) having a plurality of board terminals, mounting the PCB inside the hollow drum body with a fixing member such that the board terminals of the PCB are placed in the slot of the hollow drum body, coating a first insulating layer on an outer circumference of the hollow drum body, forming a plurality of ring electrodes on the first insulating layer corresponding to the board terminals of the PCB, in which the portion of ring electrodes that corresponds to the board terminals of the PCB is non-continuous, exposing the board terminals below the non-continuous area of the ring electrodes by etching the first insulating layer with the ring electrodes as an etching mask, and forming a connecting electrode to electrically connect the board terminals to the ring electrodes.

The method may further include, after the forming of the plurality of ring electrodes, coating a second insulating layer on an outer circumference of the hollow drum body on which the ring electrodes and the connecting electrode are formed.

The second insulating layer may be made out of a polycarbonate or parylene.

The forming the plurality of ring electrodes may include coating a conductive layer on the first insulating layer, coating a photoresist layer on the conductive layer, forming a photoresist etching mask by selective exposure and developing of the photoresist layer, and forming the ring electrodes non-continuously at the portion that corresponds to the board terminals of the PCB by etching the conductive layer with the photoresist etching mask.

The hollow drum body may be made out of aluminum or an aluminum alloy.

The plurality of board terminals may be spaced apart from each other by a pitch which ranges from about 20 μm to about 50 μm.

The fixing member may include an insulating epoxy adhesive.

The first insulating layer may be made out of a polycarbonate or parylene.

The plurality of ring electrodes may be arranged at a same pitch as that of the board terminals.

The plurality of ring electrodes may be spaced apart from each other by a pitch which ranges from about 20 μm to about 50 μm.

The plurality of ring electrodes may be made out of copper or nickel.

The connecting electrode may be made out of copper or nickel.

The forming the connecting electrode may include aligning a screen mask having a plurality of openings to expose an area of forming the connecting electrode such that the plurality of openings are aligned with the area of forming the connecting electrode, and placing the screen mask on the drum body, and providing the surface of the screen mask with a conductive particle.

The providing the conductive particle may include one of sputtering, heat deposition, and silk screen.

The foregoing and/or other aspects and utilities of the present general inventive concept may be achieved by providing an image drum. The image drum may include a hollow drum body having a slot extending in a longitudinal direction, a printed circuit board (PCB) mounted inside the hollow drum body and having a plurality of board terminals placed in the slot of the hollow drum body, a plurality of ring electrodes arranged on an outer circumference of the hollow drum body excluding the slot, with an intervention of a first insulating layer disposed therebetween, the ring electrodes arranged at a predetermined interval apart from each other, a connecting electrode to electrically connect the plurality of board terminals exposed through the slot to the plurality of ring electrodes, and a second insulating layer coated on an outer circumference of the hollow drum body to cover the plurality of ring electrodes and the connecting electrode.

BRIEF DESCRIPTION OF THE DRAWINGS

These and/or other aspects and utilities of the present general inventive concept will become apparent and more readily appreciated from the following description of the exemplary embodiments, taken in conjunction with the accompanying drawings of which.

Throughout the drawings, the same drawing reference numerals will be understood to refer to the same elements, features and/or structures.

DETAILED DESCRIPTION OF THE PREFERRED EMBODIMENTS

Figure 1:
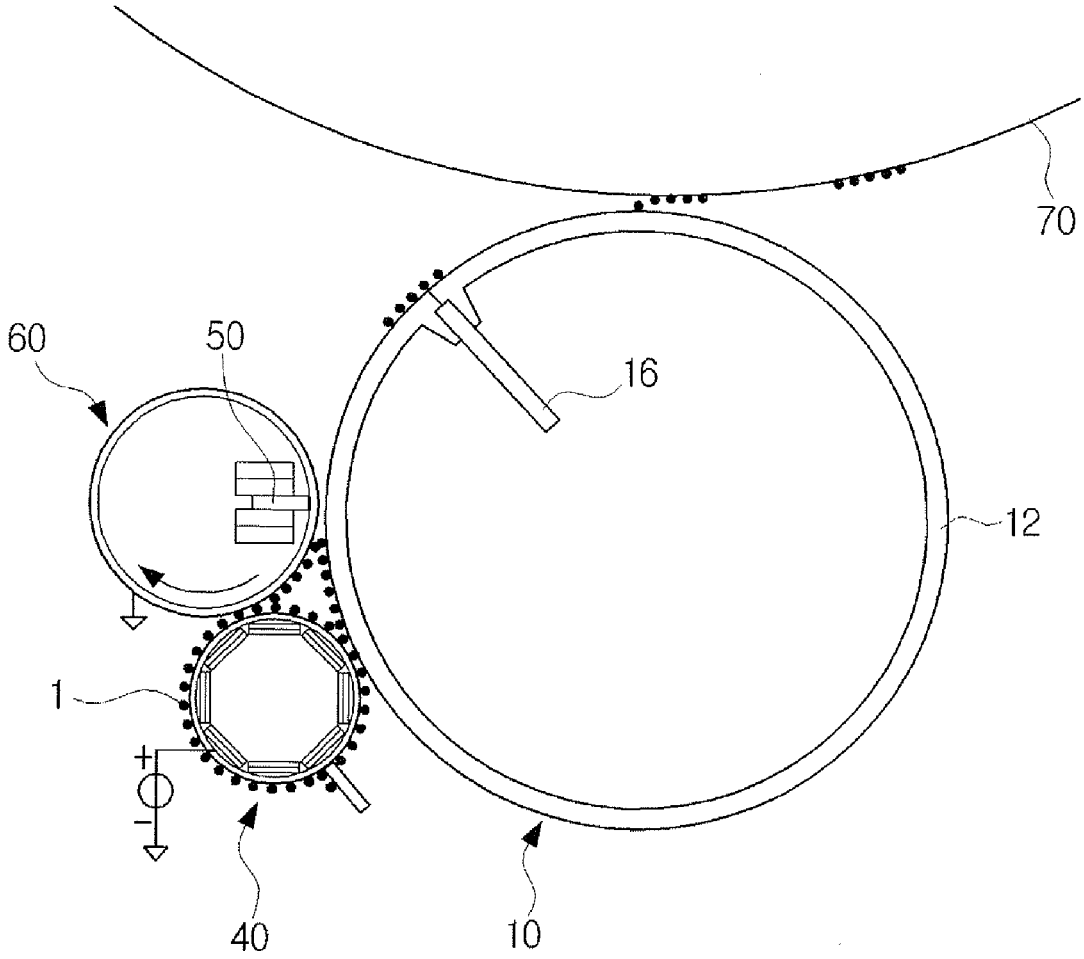
FIG. 1 (RELATED ART)
FIG. 1 is a side view of an image forming apparatus employing a conventional image drum.
Figure 2:
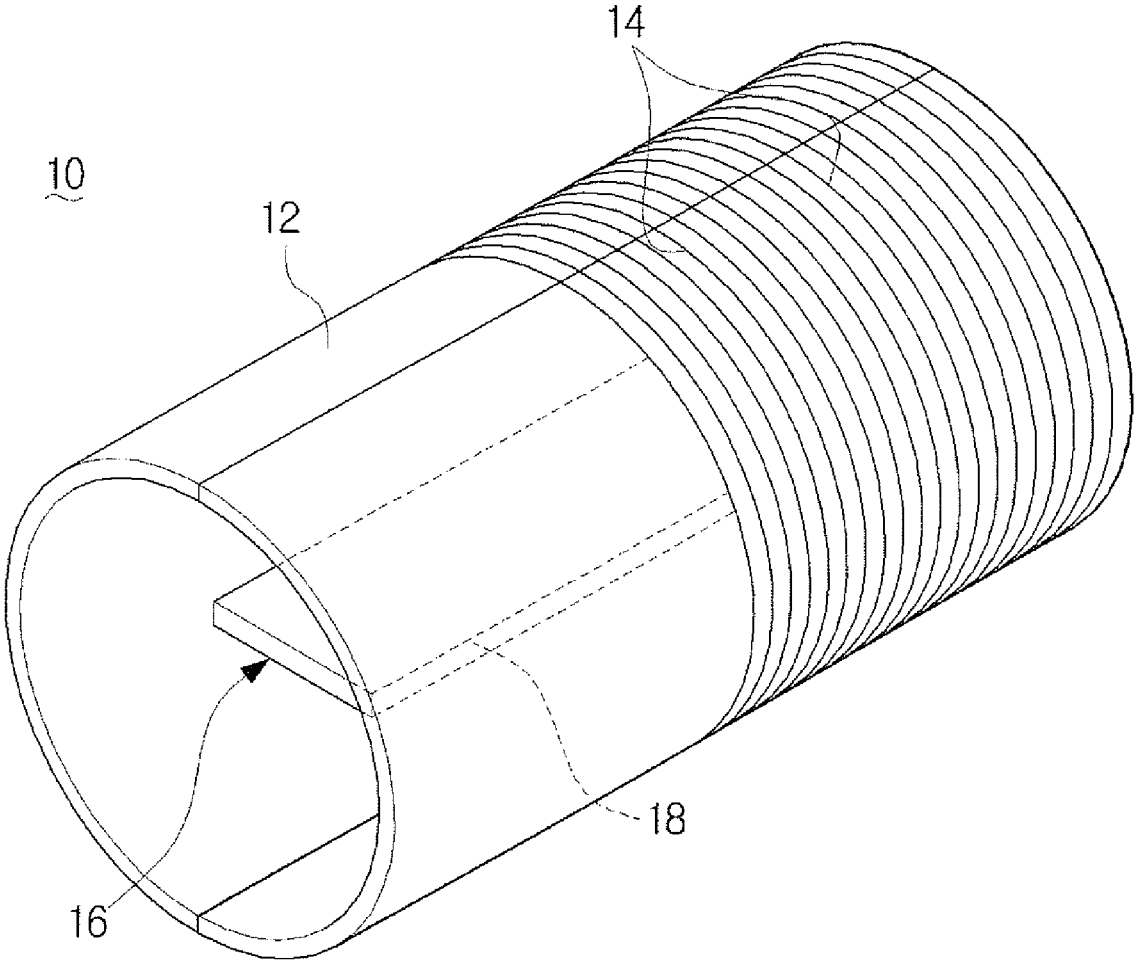
FIG. 2 (RELATED ART)
FIG. 2 is a perspective view of a conventional image drum.
Figure 3:
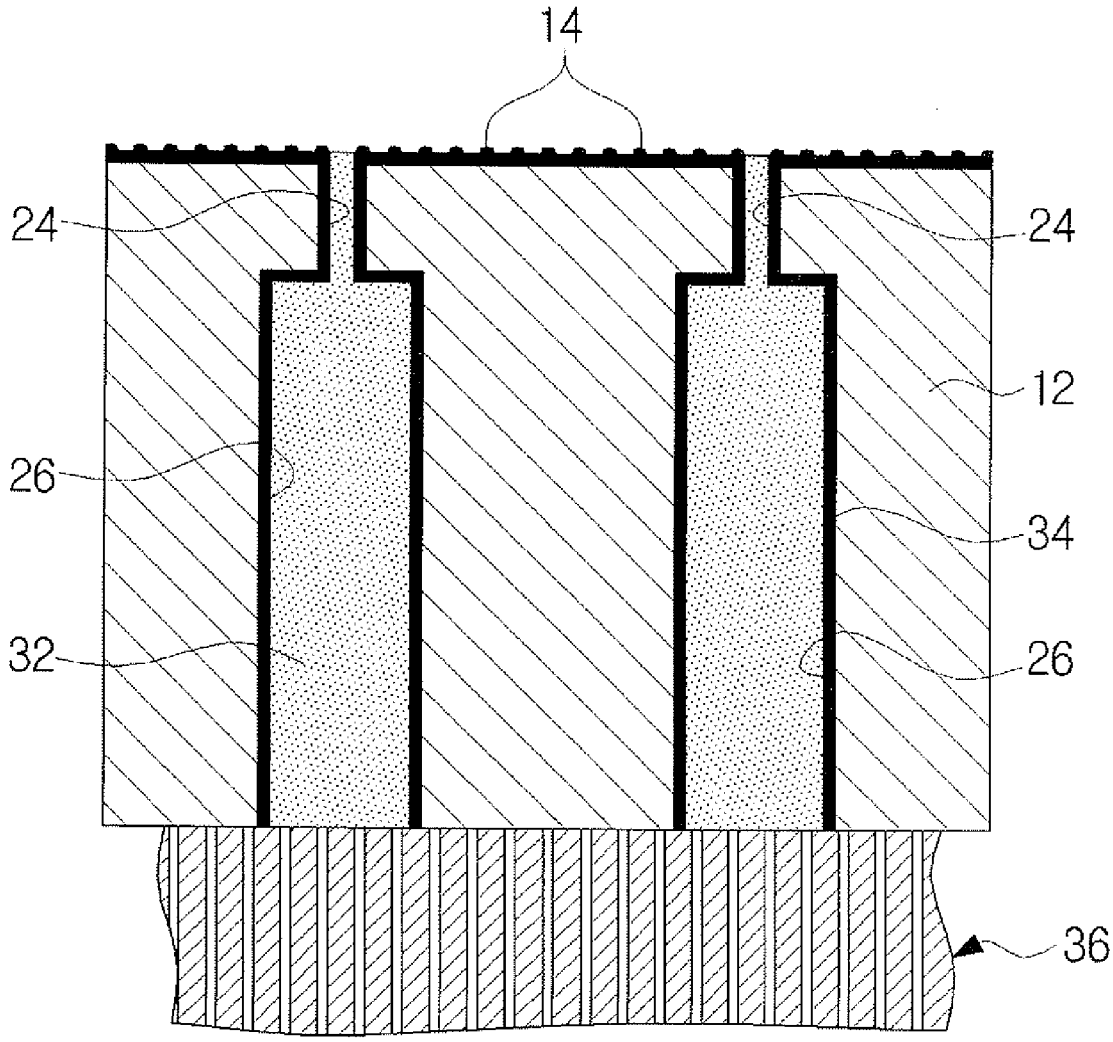
FIG. 3 (RELATED ART)
FIG. 3 is a cross-section view of part of an outer wall of the image drum of FIG. 2.

Reference will now be made in detail to exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

Figure 4A:
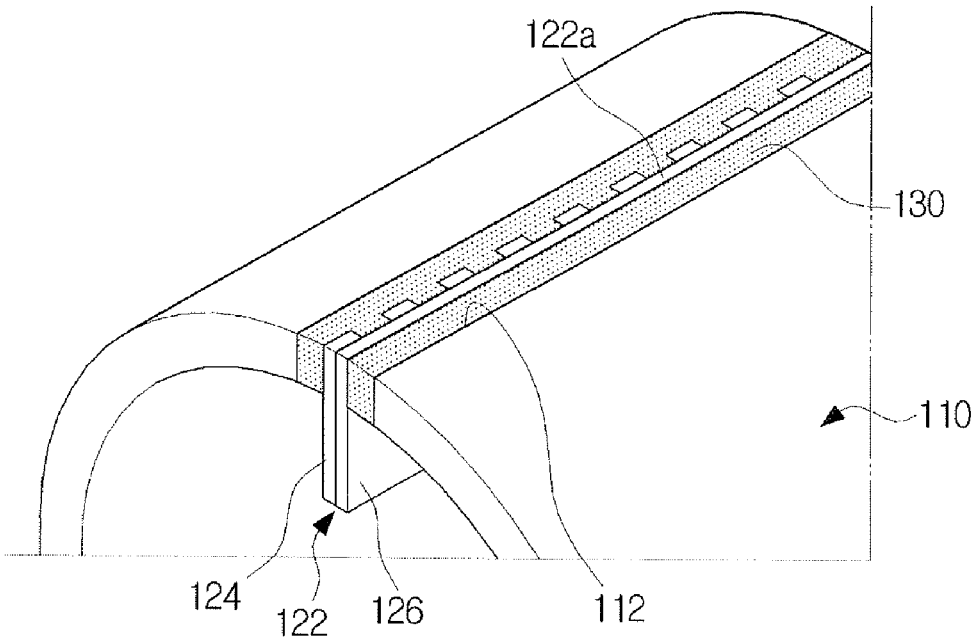
FIG. 4A is a perspective view, partially in cross-section, illustrating a printed circuit board (PCB) coupled to a drum body of an image drum according to an exemplary embodiment of the present general inventive concept.
Figure 4B:
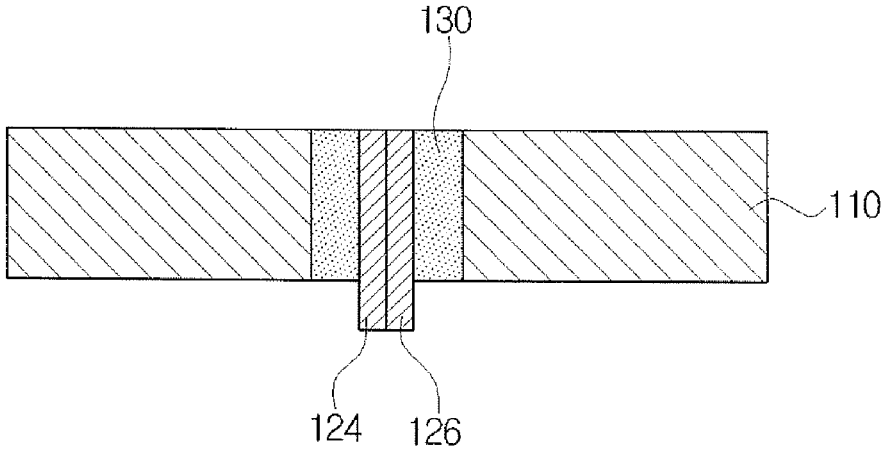
FIG. 4B is an enlarged cross-section view illustrating the main portion of FIG. 4A.

An image drum and a method of fabricating the image drum according to the exemplary embodiments of the present general inventive concept will be explained below with reference to FIGS. 4 to 11, in which FIG. 4A is a partial perspective view illustrating a printed circuit board (PCB) assembled with the drum body, and FIG. 4B is an enlarged cross-section view illustrating the main portion of FIG. 4A.

Referring to FIGS. 4A and 4B, the drum body 110 may be implemented as a hollow cylinder having a slot 112 which is open in a lengthwise direction, such as a longitudinal direction. A printed circuit board (PCB) is coupled with the slot 112 of the drum body 110. The PCB 122 is disposed inside an inner space of the drum body 110, a first edge 122*a* of the PCB 122 is inserted in the slot 112 of the drum body 110 and bonded by a bonding member 130. The bonding member 130 is desirably an insulating material such as an epoxy adhesive. However, the present general inventive concept is not limited thereto. The drum body 110 may preferably be made out of a metal, such as aluminum, which has a high thermal conductivity, and mechanical strength and workability.

A control chip (not illustrate) is mounted in the PCB 122 to cause an electric voltage to be supplied to the ring electrodes which will be formed at a later stage. The PCB 122 includes a plurality of conductive board terminals 124 to electrically connect the ring electrodes to the control chip, and an insulating board 126 to support the board terminals 124 and the control chip. The exposed side of the PCB 122 is coated by an insulating material, although not illustrated herein.

The plurality of board terminals 124 are desirably formed at a same pitch as that of the ring electrodes, in order to be aligned with the ring electrodes, and extend up to the first edge 122*a* of the PCB 122.

The board terminals 124 are arranged in a minute pattern configuration which are formed at a fine distance apart from one another. The board terminals 124 preferably have pitches ranging from about 20 μm to about 50 μm in consideration of the desired resolution of the image forming apparatus where the image drum is employed, which is approximately 600 dpi, and the limits and economic factors related with the fabrication of the ring electrodes.

Figure 5A:
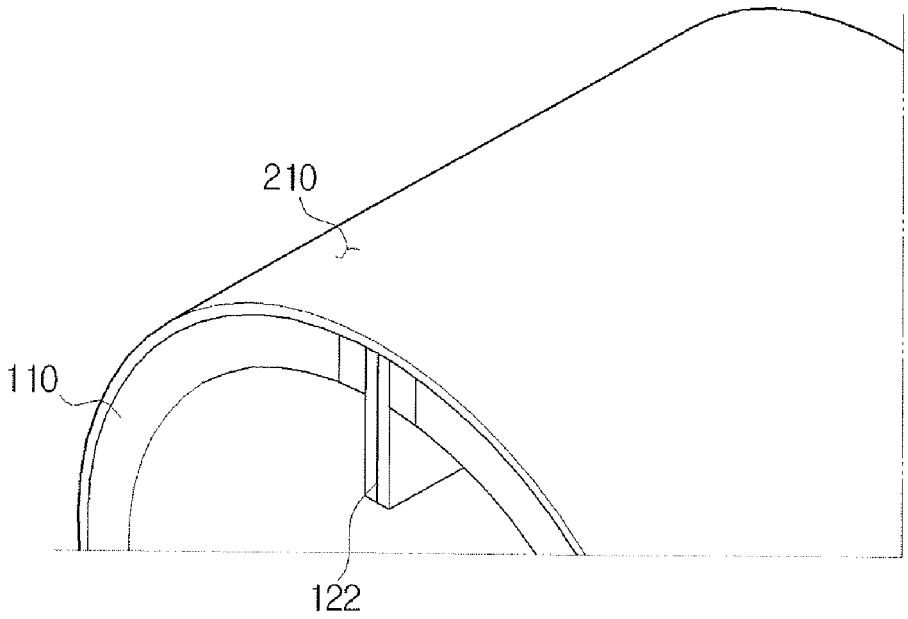
FIG. 5A is a perspective view, partially in cross-section, illustrating a first insulating layer coated on the drum body coupled with the PCB.
Figure 5B:
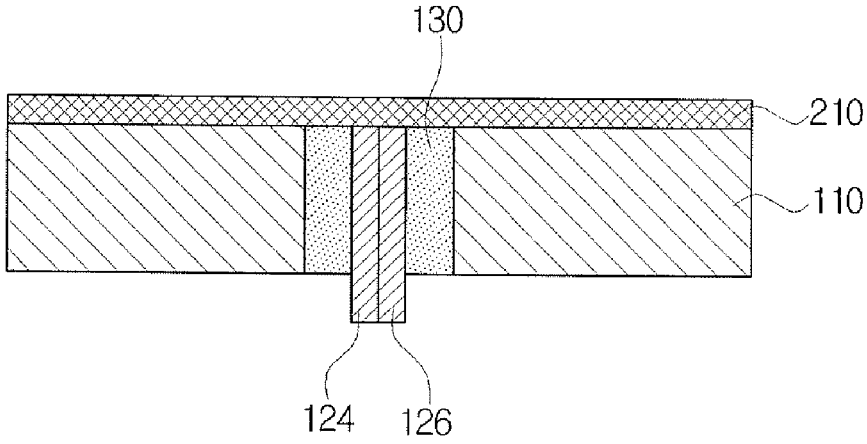
FIG. 5B is an enlarged cross-section view illustrating the main portion of FIG. 5A.

FIG. 5A is a perspective view, partially in cross-section, illustrating a first insulating layer coated on the drum body with the PCB coupled thereto. FIG. 5B is an enlarged cross-section view illustrating the main portion of FIG. 5A in enlargement.

Referring to FIGS. 5A and 5B, the first insulating layer 210 is coated on an outer circumference of the drum body 110 with respect to a circumference to which the PCB 122 is coupled. The first insulating layer 210 may be made out of materials such as polycarbonate or parylene in order to electrically insulate the ring electrodes, which are formed at a later stage, from the drum body 110. However, the present general inventive concept is not limited thereto. That is, the first insulating layer 210 may be made out of various other insulating materials.

FIGS. 6A through 8B illustrate a plurality of ring electrodes formed on the drum body 110 with the first insulating layer 210 formed thereon.

Figure 6A:
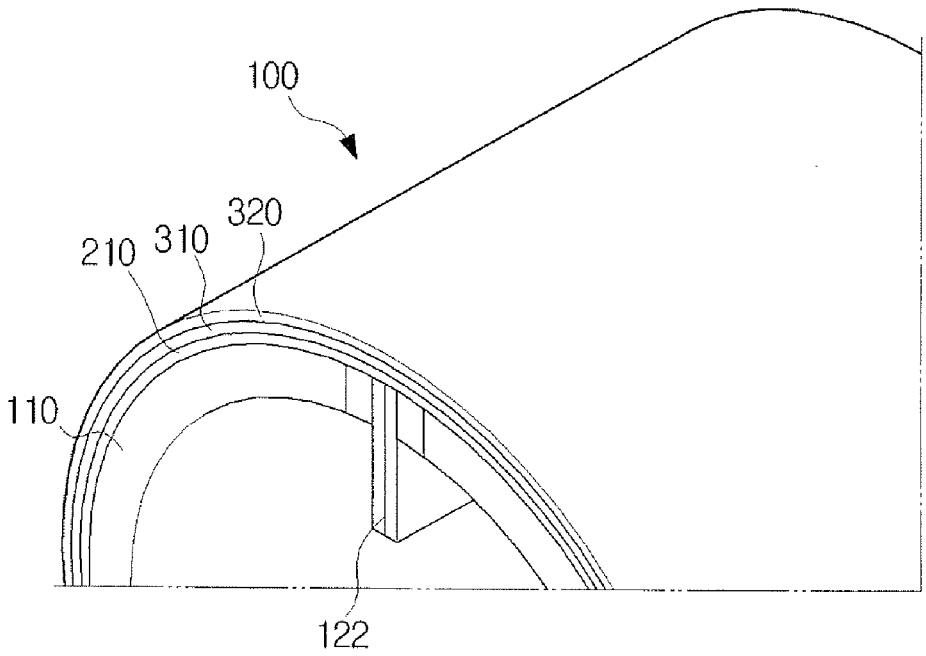
FIGS. 6A through 8B are views illustrating a plurality of ring electrodes formed on the drum body on which the first insulating layer is coated.
Figure 6B:
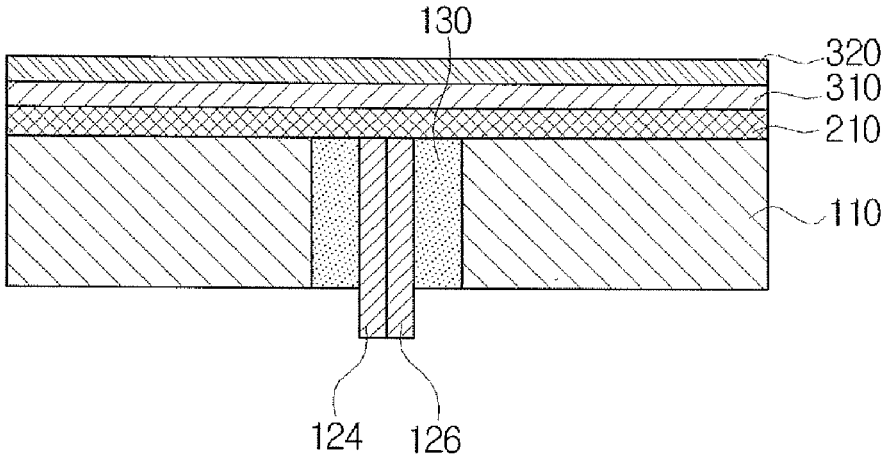

Referring to FIGS. 6A and 6B, a conductive layer 310 and a photoresist layer 320 are coated in sequence, onto the outer circumference of the first insulating layer 210 which was coated on the drum body 110. The conductive layer 310 may be made out of materials such as copper or nickel, and is used to form the ring electrodes with the use of an etching process. The photoresist layer 320 forms a photoresist etching mask layer during a process of etching the conductive layer 310 in order to form ring electrodes. The photoresist layer 320 may desirably have a positive characteristic, from which an area exposed to UV is eliminated by the developer.

Figure 7A:
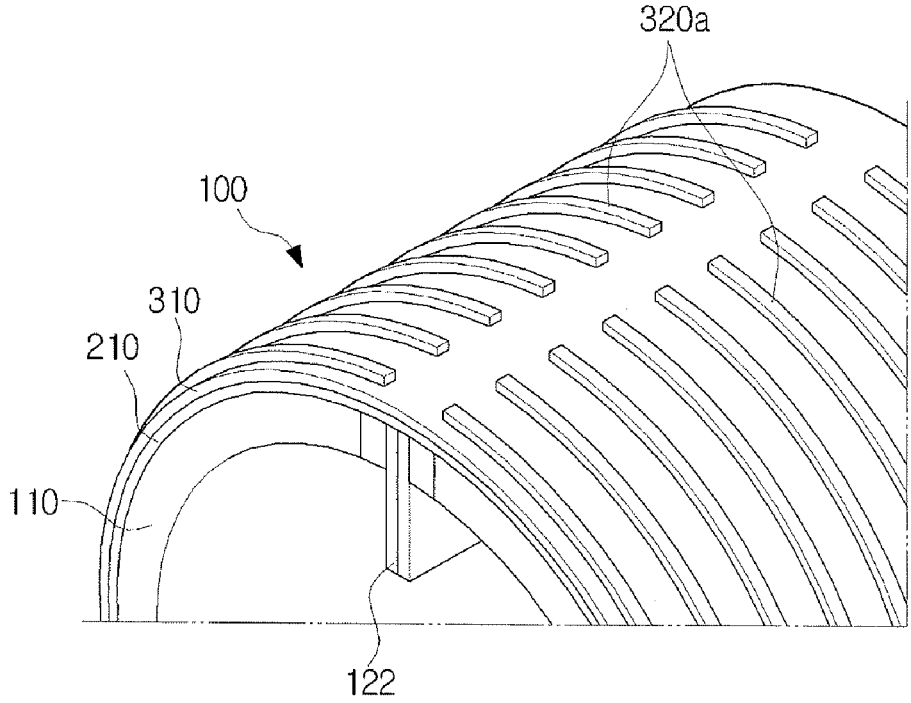
Figure 7B:
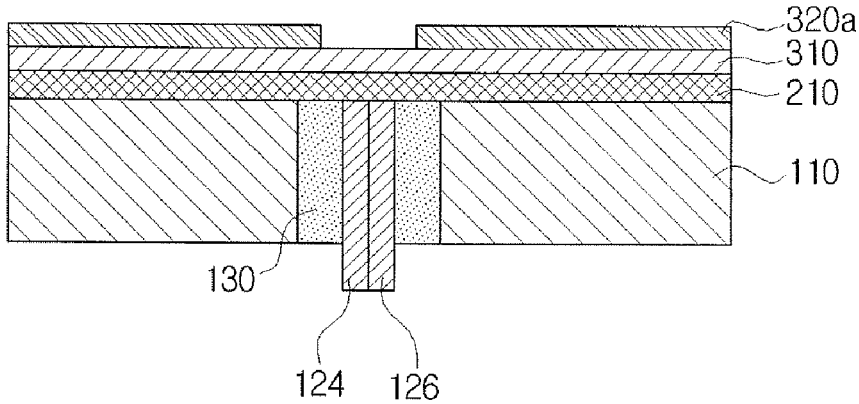
Figure 7C:
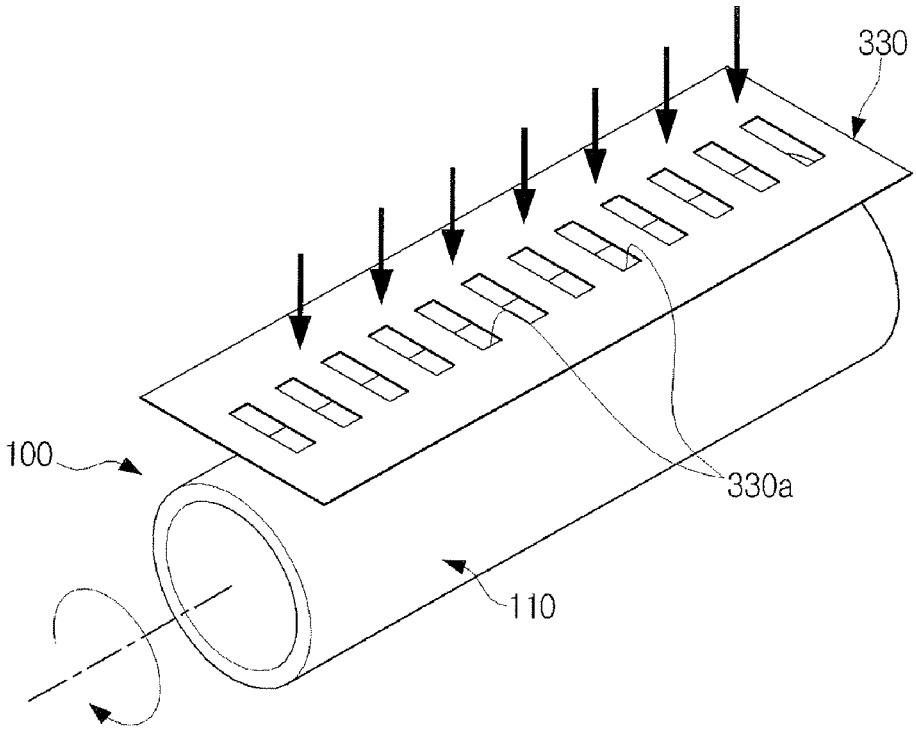
Figure 7D:
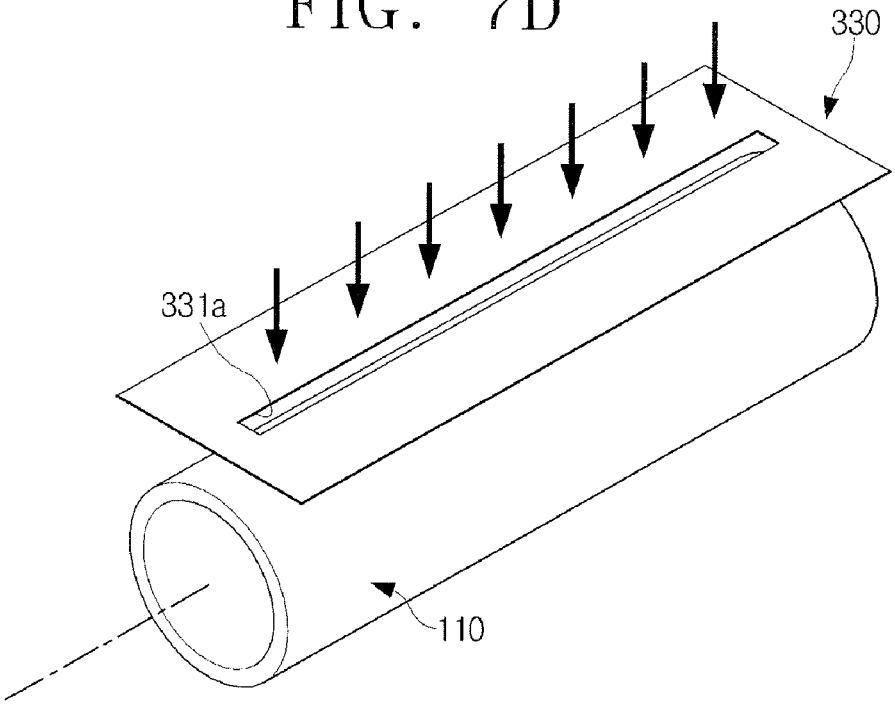

Referring to FIGS. 7A and 7B, the photoresist layer 320 is selectively exposed to light and developed to thereby form a photoresist etching mask layer 320*a*. The selective light exposure includes a first light exposure as illustrated in FIG. 7C, and a second light exposures as illustrated in FIG. 7D. In the first light exposure, a first photo mask 330 is aligned to the drum body 110 and fixed in place, wherein the first photo mask 330 has a plurality of openings 330*a* spaced apart at the same pitch as the ring electrodes which are to be formed, and exposed to an ultraviolet (UV) light source (not illustrated) while the drum body 110 is rotated. In the second light exposure, a second photo mask 331 is aligned to the drum body 110 and fixed in place, wherein the second photo mask 331 has a hole or a slot extending in a lengthwise direction, such as a longitudinal direction, of the drum body 110 in order to open a portion of the photoresist 320 that corresponds to the board terminals 124 of the ring electrodes, which are to be formed, and is exposed to the UV light source.

Figure 8A:
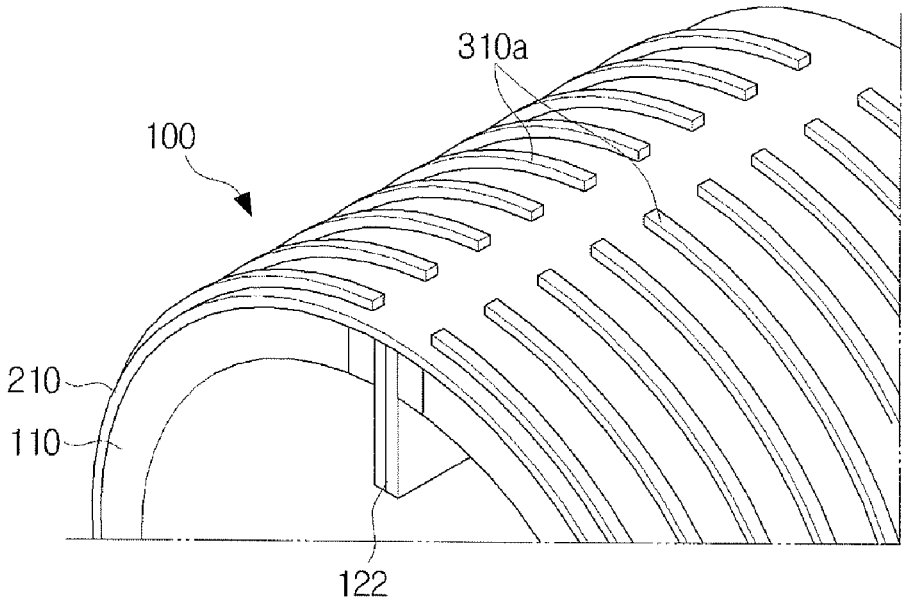
Figure 8B:
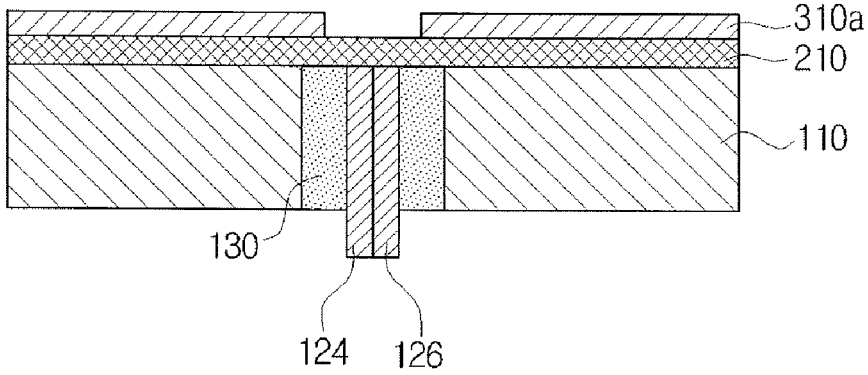

Referring to FIGS. 8A and 8B, the conductive layer 310 is etched using the photoresist etching mask layer 320*a*, and the photoresist etching mask layer 320*a* is removed in order to form a plurality of ring electrodes 310*a* around the outer circumference of the drum body 110 and which are disposed at a constant pitch apart from each other along the longitudinal length of the drum body 110. The portion of the ring electrodes 310*a* that corresponds to the board terminals 124 of the PCB 12 is exposed. The pitch of the ring electrodes 310*a* is identical or substantially similar to that of the board terminals 124, which ranges approximately from about 20 μm to about 50 μm. The etching mask layer may be kept in the ring electrode forming stage, and then removed at a later stage, for example, in the stage of removing the first insulating layer. That is, the etching mask layer 320*a* may be left on in order to protect the first insulating layer 210 from an attack of an organic solvent, which is used in the removal of the etching mask layer, and then the etching mask layer may be removed when the first insulating layer is removed.

Figure 9A:
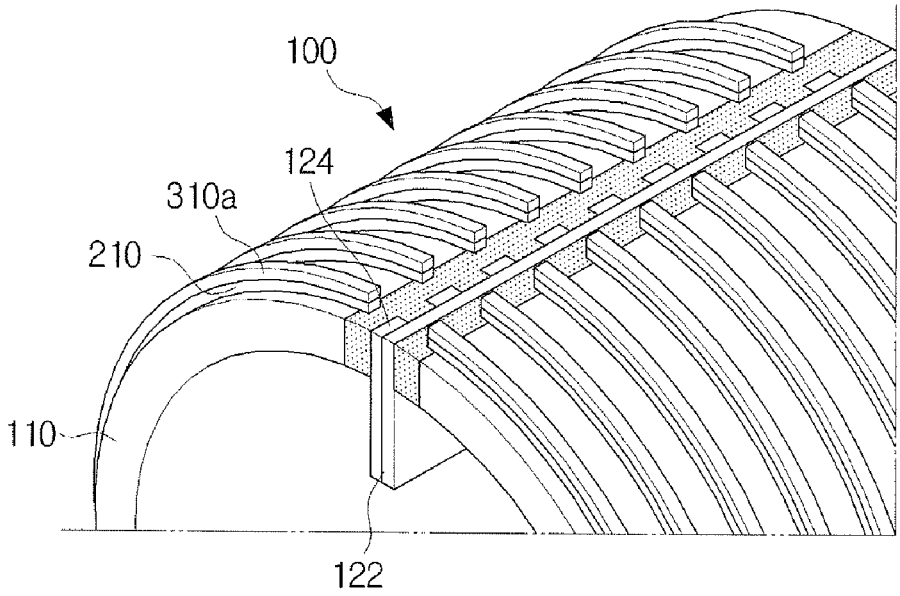
FIG. 9A is a perspective view, partially in cross-section, illustrating a PCB terminal exposed through a lower portion of the ring electrodes which is opened by etching the first insulating layer of the ring electrodes using an etching mask.
Figure 9B:
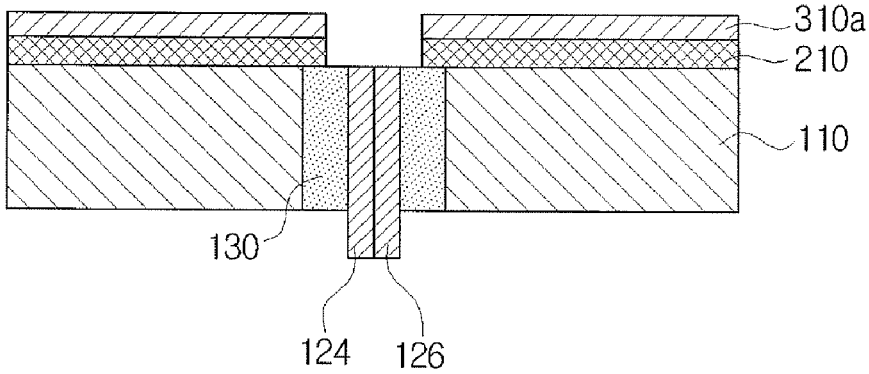
FIG. 9B is an enlarged cross-section view illustrating the main portion of FIG. 9A.

FIG. 9A is a perspective view, partially in cross-section, illustrating a PCB terminal exposed through a lower portion of the ring electrodes 310*a* which is opened by etching the first insulating layer 210 of the ring electrodes 310*a* using an etching mask, and FIG. 9B is an enlarged cross-section view illustrating the main portion of FIG. 9A.

Referring to FIGS. 9A and 9B, when the plurality of ring electrodes 310*a* is formed on the first insulating layer 210, which is coated on the drum body 110, the first insulating layer 210 is eliminated by using the ring electrodes 310*a* as an etching mask. By removing an area of the first insulating layer 210 which is not covered by the ring electrodes 310*a*, the board terminals 124 formed underneath the ring electrodes 310*a* are exposed in the open area of the ring electrodes 310*a*. If the first insulating layer 210 is made out of polycarbonate or parylene, an oxygen plasma ashing may be used for etching the first insulating layer 210. However, the present general inventive concept is not limited thereto.

Figure 10A:
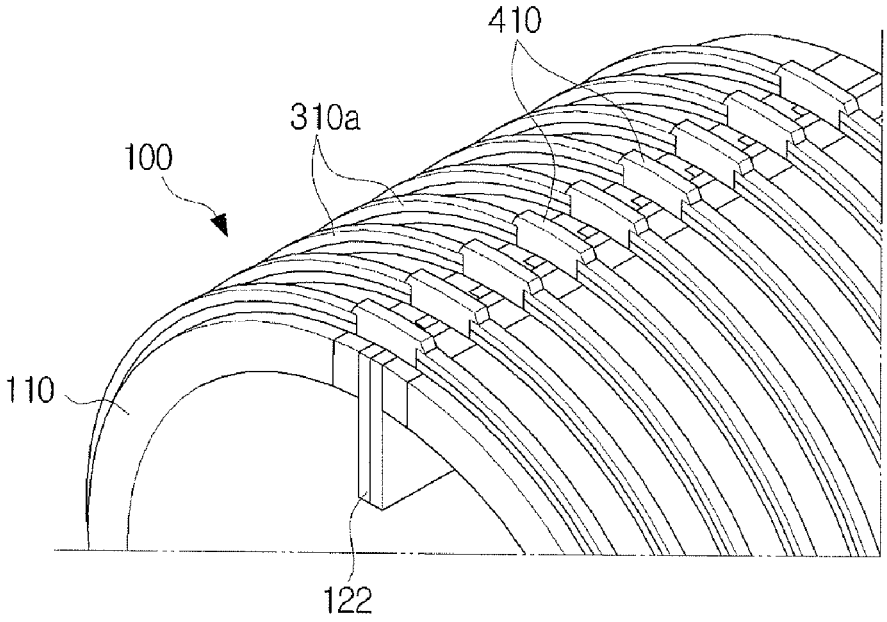
FIG. 10A is a perspective view, partially in cross-section, illustrating a connecting electrode formed, electrically connecting the PCB terminal with the ring electrodes.
Figure 10B:
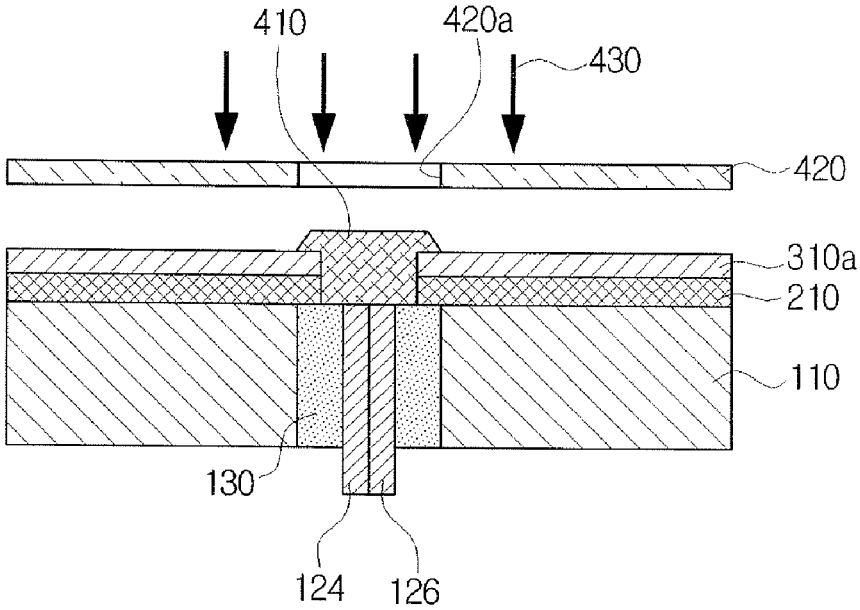
FIG. 10B illustrates the forming of the connecting electrode.

FIG. 10A is a perspective view, partially in cross-section, illustrating a connecting electrode formed, electrically connecting the PCB terminal with the ring electrodes, and FIG. 10B illustrates the forming of the connecting electrode.

Referring to FIGS. 10A and 10B, if the board terminals 124 which are formed underneath the first insulating layer 210 are exposed through the open area of the ring electrodes 310*a*, connecting electrodes 410 are formed in order to electrically connect the board terminals 124 to the ring electrodes 310*a*. The process of forming the connecting electrode 410 may include aligning a screen mask 420 so that a plurality of openings 420*a*, formed at a same pitch as those of the board terminals 124 and the ring electrodes 310*a*, are used to expose the connecting electrode 410 therethrough, are aligned with the area of forming the connecting electrode 410; placing the screen mask 420 close to the drum body 110; and providing the surface of the screen mask 420 with the conductive particles 430. The connecting electrode 410 may be made out of metals such as copper or nickel, and the conductive particles 430 may be applied over the surface of the screen mask 420 by sputtering, heat deposition, or silk screen. However, the present general inventive concept is not limited thereto.

Figure 11A:
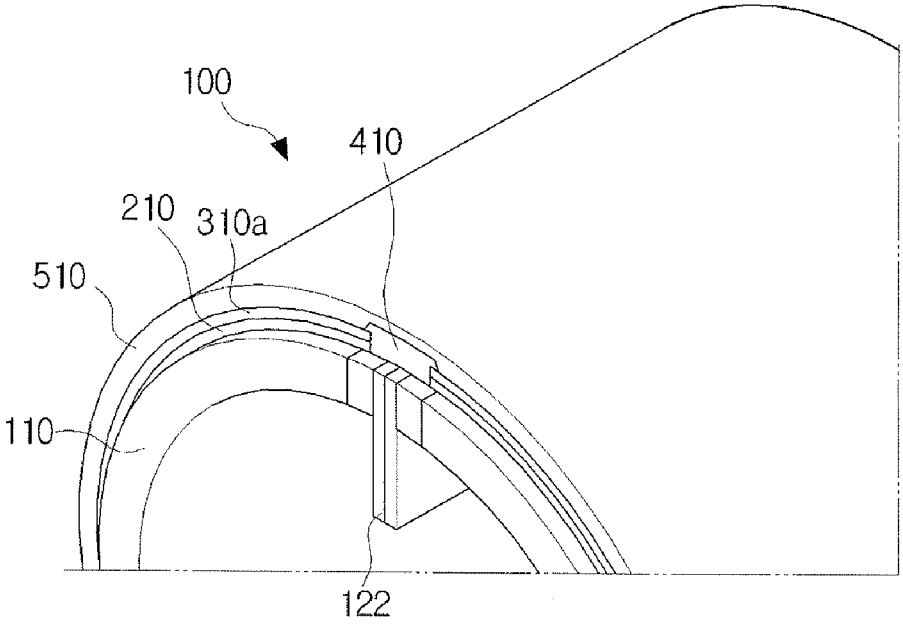
FIG. 11A is a perspective view, partially in cross-section, illustrating a second insulating layer coated on the outer circumference of the drum body with the connecting electrode formed thereon.
Figure 11B:
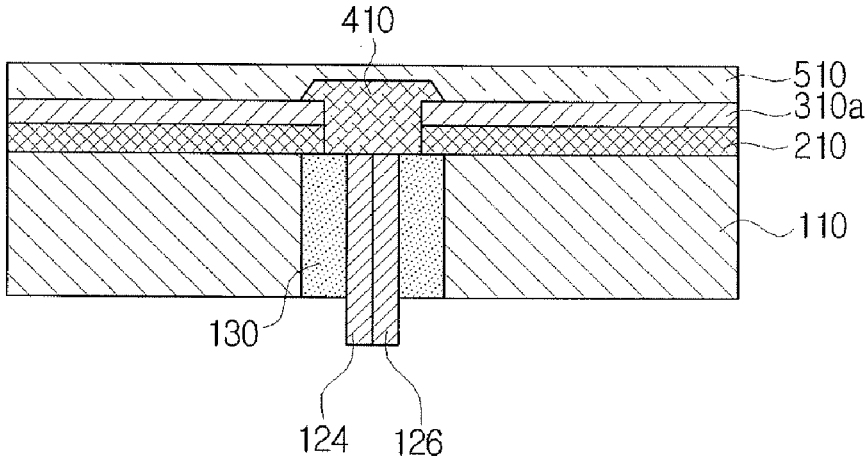
FIG. 11B is an enlarged cross-section view illustrating the main portion of FIG. 11A.

FIG. 11A is a perspective view, partially in cross-section, illustrating a second insulating layer 510 coated on an outer circumference of the drum body 110 with respect to the circumference of the drum body 110 the connecting electrodes are formed on, and FIG. 11B is an enlarged cross-section view illustrating the main portion of FIG. 11A.

Referring to FIGS. 11A and 11B, if the connecting electrode 410 is formed, the second insulating layer 510 is coated on the outer circumference of the drum body 110 in order to cover the connecting electrode 410 and the ring electrodes 310*a*. As a result, fabricating an image drum 100 is completed according to the exemplary embodiments of the present general inventive concept. The second insulating layer 510 may be made out of materials such as polycarbonate, parylene or SiOx. However, the present general inventive concept is not limited thereto.

According to the exemplary embodiments of the present general inventive concept as explained above, a laser precision processing is not required in order to form a connecting part between ring electrodes and terminals of a PCB. As a result, it is easy and efficient to fabricate an image drum, and thus is beneficial for mass-producing, and the image drum can be provided with a reduced unit price due to reduced fabricating cost.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. A method of fabricating an image drum, the method comprising:

preparing a hollow drum body having a slot extending in a longitudinal direction;

preparing a printed circuit board (PCB) comprising board terminals;

mounting the PCB inside the hollow drum body with a fixing member such that the board terminals of the PCB are placed in the slot of the hollow drum body;

coating a first insulating layer on an outer circumference of the hollow drum body;

forming non-continuous ring electrodes on the first insulating layer corresponding to the board terminals of the PCB, the non-continuous ring electrodes each having ends disposed adjacent to a corresponding one of the board terminals and on opposite sides of the slot;

exposing the board terminals between the ends of the non-continuous ring electrodes by etching the first insulating layer using the non-continuous ring electrodes as an etching mask; and forming connecting electrodes to electrically connect the board terminals to the corresponding non-continuous ring electrodes.

2. The method of claim 1, further comprising:

coating a second insulating layer on an outer circumference of the hollow drum body, the non-continuous ring electrodes, and the connecting electrodes.

3. The method of claim 2, wherein the second insulating layer is made out of a polycarbonate or parylene.

4. The method of claim 1, wherein the forming the non-continuous ring electrodes comprises:

coating a conductive layer on the first insulating layer;

coating a photoresist layer on the conductive layer;

forming a photoresist etching mask by selective exposure and developing of the photoresist layer; and etching the conductive layer with the photoresist etching mask to form the ends of the non-continuous ring electrodes.

5. The method of claim 1, wherein the hollow drum body is made out of aluminum or an aluminum alloy.

6. The method of claim 1, wherein the board terminals are spaced apart from each other by a pitch which ranges from about 20 μm to about 50 μm.

7. The method of claim 1, wherein the fixing member comprises an insulating epoxy adhesive.

8. The method of claim 1, wherein the first insulating layer is made out of a polycarbonate or parylene.

9. The method of claim 1, wherein the non-continuous ring electrodes are arranged at a same pitch as that of the board terminals.

10. The method of claim 1, wherein the non-continuous ring electrodes are spaced apart from each other by a pitch which ranges from about 20 μm to about 50 μm.

11. The method of claim 1, wherein the non-continuous ring electrodes are made out of copper or nickel.

12. The method of claim 1, wherein the connecting electrodes are made out of copper or nickel.

13. The method of claim 1, wherein the forming the connecting electrodes comprises:

aligning a screen mask having a plurality of openings to expose an area of forming the connecting electrode such that the plurality of openings are aligned with the area of forming the connecting electrodes, and placing the screen mask on the drum body; and providing the surface of the screen mask with conductive particles.

14. The method of claim 13, wherein the providing the conductive particles comprises one of sputtering, heat deposition, and silk screening.

* * * * *